United States Patent [19]

Audeh

[11] Patent Number: 4,966,683

[45] Date of Patent: Oct. 30, 1990

[54] PROCESS FOR THE REMOVAL OF MERCURY FROM NATURAL GAS CONDENSATE

[75] Inventor: Costandi A. Audeh, Princeton, N.J.

[73] Assignee: Mobil Oil Corporation, Fairfax, Va.

[21] Appl. No.: 343,658

[22] Filed: Apr. 27, 1989

[51] Int. Cl.[5] ..... C01G 13/00; C07C 7/148; C10G 29/02

[52] U.S. Cl. ..... 208/251 H; 208/251 R; 208/293; 423/101; 585/811

[58] Field of Search ..... 423/210, 101, 102; 585/811, 826, 841, 856; 208/251 R, 251 H, 252, 253, 293

[56] References Cited

U.S. PATENT DOCUMENTS

| | | | |
|---|---|---|---|
| 2,905,636 | 9/1959 | Watkins et al. | 208/251 H |
| 4,044,098 | 8/1977 | Miller et al. | 423/210 |
| 4,430,206 | 2/1984 | Rankel | 208/252 |
| 4,764,219 | 8/1988 | Yan | 423/210 |
| 4,915,818 | 4/1990 | Yan | 208/251 R |

*Primary Examiner*—Jeffrey E. Russel
*Assistant Examiner*—Brian M. Bolam
*Attorney, Agent, or Firm*—Alexander J. McKillop; Charles J. Speciale

[57] ABSTRACT

A process for the removal of mercury from natural gas condensate wherein elemental sulfur is mixed into the natural gas condensate and the mixture, along with a stream of hydrogen, is fed through a reactor containing a hydrodesulfurization catalyst.

18 Claims, No Drawings

PROCESS FOR THE REMOVAL OF MERCURY FROM NATURAL GAS CONDENSATE

BACKGROUND OF THE INVENTION

The present application is directed to a process for the removal of impurities from natural gas condensate, and particularly, to a process for the removal of mercury from natural gas condensate.

Natural gas which is produced from a natural gas well is typically separated into components, which are in turn purified to provide products for a variety of end uses. The high-pressure mixture produced from the well, i.e., the wellstream, is typically sent to a separator vessel or a series of separator vessels maintained at progressively lower pressures where the wellstream is separated into a gaseous fraction and a liquid fraction.

The gaseous fraction leaving the separator, which may contain the impurities mercury, carbon dioxide and hydrogen sulfide, is sent to a gas treatment and purification plant where typically the mercury concentration is reduced to $< 0.1$ micrograms/$m^3$, the $CO_2$ concentration is reduced to the parts per million (ppm) level, and the $H_2S$ to about one (1) ppm.

The liquid fraction is typically preheated, e.g., to 150° C., to affect partial vaporization and is then separated, for example, in a stabilizer column. In the upper section of the stabilizer column, the stream is rectified, i.e., the heavy hydrocarbons are removed from the vapor phase, and in the lower section of the stabilizer column, the liquid stream is stripped of its light hydrocarbon components. Complete stabilization can be further enhanced by heating the bottom liquid stream of the stabilizer column in a reboiler. The reboiler supplies additional heat in order to reduce the light hydrocarbon content of the liquid. The stabilizer column produces two streams, a stream which leaves the top of the stabilizer column containing low molecular weight hydrocarbons, e.g., $C_1$-$C_4$, and other gases and a stabilized condensate stream which leaves the bottom of the stabilizer column.

It has been found that the mercury in wellstreams from gas producing wells which contain mercury is partitioned among the gaseous and liquid streams. This mercury is thought to originate from the geologic deposits in which the natural gas is entrapped.

Typical steps for the processing of the liquid fraction of the wellstream do not reduce the amount of mercury in the liquid fraction leaving the separator. For example, a liquid fraction leaving the separator(s) having a mercury content of about 220 μg/kg(ppb) will yield a stabilized condensate containing about 220 μg/kg(ppb). The presence of this mercury in a natural gas condensate is undesirable and can cause damage to downstream processing equipment.

Equipment damage may result when mercury accumulates in equipment constructed of various metals, especially aluminum, by forming an amalgam with the metal. For example, in the production of ethylene, a natural gas condensate is commonly passed through a heat exchanger constructed of aluminum. Such equipment exists in the section of the ethylene manufacturing facilities where ethylene is separated from hydrogen, ethane and other hydrocarbons by chilling. It has been found that mercury tends to amalgamate with the aluminum of which the heat exchanger is constructed thereby creating the risk of corrosion cracking with potentially catastrophic results.

SUMMARY OF THE INVENTION

The present invention comprises a hydrodesulfurization process for the removal of mercury from a natural gas condensate to which sulfur has been added. The process of the present invention comprises passing hydrogen gas along with a natural gas condensate to which elemental sulfur has been added, over a catalyst, e.g. a cobalt/molybdenum catalyst. The present invention minimizes the risk of equipment failure by providing a process for the removal of mercury from natural gas condensates. Since the equipment required to practice the present invention commonly exists in the plants of end users of natural gas condensate, large capital expenditures may be unnecessary.

DETAILED DESCRIPTION OF THE INVENTION

The present invention minimizes the risk of harm to expensive downstream processing equipment, by reducing the amount of mercury in a natural gas condensate. In accordance with the present invention, elemental sulfur is mixed with natural gas condensate and the mixture is then fed into a reactor containing a catalyst along with a stream of hydrogen gas.

The catalyst may be any hydrodesulfurization (HDS) catalyst known in the art, for example, Co/Mo, Ni/Mo, etc. The catalyst can be formed in any conventional manner such as by depositing a cobalt/molybdenum salt on a solid support, impregnating the solid with aqueous solutions of the desired cobalt and molybdenum salts, and then evaporating the water to dry the catalyst. The solid can be any suitable solid for the forming of a cobalt/molybdenum catalyst, for example alumina, zirconia, silica-alumina, etc. Suitable catalysts typically have large surface areas, e.g. 200 square meters per gram, and large pores, preferably at least about 20 angstroms. Such cobalt/molybdenum catalysts are well known in the art and, therefore, will not be described further herein.

The elemental sulfur is mixed in the natural gas condensate in any conventional manner such as by forming a slurry of sulfur with a portion of condensate and then adding the slurry to the natural gas condensate stream as a side-stream. The process of the present invention can be successfully carried out with from about 0.002–2% by weight elemental sulfur in the natural gas condensate, preferably about 0.05% by weight elemental sulfur in the natural gas condensate.

In practicing the process of the present invention, the catalyst is placed in a conventional reactor, such as a carbon steel reactor, and the liquid natural gas condensate/sulfur mixture as well as the hydrogen gas, are fed into the top of the reactor and allowed to flow over the catalyst. During the practice of the present invention, the mercury in the condensate reacts with the sulfur and the hydrogen according to the following formulas:

$$S+Hg \rightarrow HgS$$

$$S+H_2H_2S$$

$$H_2S+H_g \rightarrow H_gS+H_2\uparrow,$$

and the $H_gS$ is readily adsorbed by the catalyst.

The process of the present invention can advantageously be practiced with temperatures ranging from about 75° C.–300° C. and pressures ranging from about 2 to 20 atmospheres with the temperature preferably from about 120° C.–250° C. and the pressure preferably from about 10–15 atmospheres. It will be appreciated by those skilled in the art that extreme temperatures should be avoided in order to minimize the risk that the elemental sulfur will react with the natural gas condensate.

The space velocity, i.e. the volume of liquid flowing through the reactor every hour divided by the volume of the catalyst, is preferably kept below about 20. Suitable feed ratios of the condensate-elemental sulfur mixture to the hydrogen gas include the range of from 1:600 to 1:1200 and are preferably in the range of from about 1:600 to 1:750.

The product leaving the reactor contains a mixture of hydrogen, hydrogen sulfide, and natural gas condensate having a reduced amount of mercury.

These components may be separated by conventional steps, for example, the pressure of the stream may be reduced thereby allowing the hydrogen gas to leave the condensate. At this point in the process, the hydrogen gas aids in the removal of the unreacted $H_2S$ from the condensate. It will be appreciated by those skilled in the art that the hydrogen gas may be recycled for economic efficiency.

While not always necessary, in one embodiment of the present invention, the catalyst is pre-sulfided before introducing the condensate-$H_2S$ mixture and/or hydrogen gas into the reactor. The catalyst can be pre-sulfided by preheating the catalyst to about 250° C.–400° C. and then passing an inert gas containing hydrogen sulfide, for example 4–5% by weight hydrogen sulfide, over the catalyst at atmospheric pressure.

It will appreciated by those skilled in the art that the natural gas condensate which is treated in accordance with the present invention typically comprises, in addition to mercury, trace amounts of nickel, vanadium, salt, moisture and sediment.

The process of the present invention has been successful in reducing the amount of mercury in natural gas condensate from above about 200 ppb to below about 20 ppb. It will be appreciated by those skilled in the art that the mercury content of the natural gas condensate can be determined by conventional methods, such as ASTM method D-3223.

The process of the present invention is further illustrated by the following examples:

EXAMPLE 1

About 4 gms of elemental sulfur were dissolved in about 1000 gms of natural gas condensate containing 200 ppb mercury. A catalyst, comprising 1 ml (about 0.8 gms) of alumina impregnated with cobalt/molybdenum salts, and which had been previously sulfided, was placed in a stainless steel reactor equipped with a means for temperature and pressure control, a means of heating, a hydrogen supply, pumps and a recovery system.

Hydrogen gas and the sulfur-containing condensate were introduced into the reactor at a pressure of 100 psig and 130° C. The flow rates were:

Natural gas condensate mixture 10 ml/hour, hydrogen 120 ml/min.

The product leaving the reactor was a mixture of hydrogen, hydrogen sulfide, and treated natural gas condensate This mixture was cooled to about −10° C. to ensure that light ends were not lost from the natural gas condensate and to recover the natural gas condensate for mercury determination. The gas was purified by reacting the hydrogen sulfide with zinc oxide and sodium hydroxide and the purified gas was vented. The natural gas condensate, after the application of this procedure, had a mercury content of about 17 ppb.

EXAMPLE 2

A repeat of Example 1 using the same natural gas condensate, the same feeding rates, the same process equipment and the same recovery system but at a temperature of 266° C. The treated natural gas condensate had a mercury content of about 9 ppb.

EXAMPLE 3

A repeat of Example 2 but the condensate had 0.4 gms added sulfur/1000 gms of condensate. The treated condensate had a mercury content of about 10 ppb.

These examples demonstrate that the mercury content of a natural gas condensate to which elemental sulfur is added can be reduced from above about 200 ppb to below about 20 ppb by passing the sulfur-containing natural gas condensate and hydrogen gas over a catalyst.

It will also be appreciated that the present invention provides a relatively simple process for the removal of mercury for natural gas condensates. The present invention is particularly suited for removing mercury from small batches of natural gas condensate, for example, a tank car which has been shipped to an end user. Since the process of the present invention can be practiced using conventional equipment, e.g. hydroprocessing equipment, which is found in the plants of many end users of natural gas condensate, with only minor modifications, large capital expenditures can be avoided. The present invention thereby provides an economical process for the removal of mercury from natural gas condensates.

I claim:

1. A process for the removal of mercury from natural gas condensate comprising the steps of:

mixing elemental sulfur with said natural gas condensate, passing said mixture of natural gas condensate and elemental sulfur over a catalyst in a reactor, and simultaneously passing hydrogen gas over said catalyst.

2. A process according to claim 1 wherein said catalyst is a hydrodesulfurization catalyst.

3. A process according to claim 1 wherein said catalyst is a cobalt/molybdenum catalyst.

4. A process according to claim 1 wherein said catalyst is presulfided by passing hydrogen sulfide over said catalyst prior to passing said mixture and said hydrogen gas over said catalyst.

5. A process according to claim 1 wherein said reactor vessel is maintained at a pressure between about 2–20 atmospheres.

6. A process according to claim 1 wherein said reactor vessel is maintained at a pressure between about 10–15 atmospheres.

7. A process according to claim 1 wherein said reactor vessel is maintained at a temperature between about 75° C.–300° C.

8. A process according to claim 1 wherein said reactor vessel is maintained at a temperature between about 120° C.–250° C.

9. A process according to claim 1 wherein the volume of said condensate passing over said catalyst every hour divided by the volume of said catalyst is below about 20.

10. A process according to claim 1 wherein said mixture comprises between about 0.002–2% elemental sulfur.

11. A process according to claim 1 wherein said mixture comprises about 0.05% elemental sulfur.

12. A process for the removal of mercury from natural gas condensate comprising the steps of:

mixing elemental sulfur with said natural gas condensate, passing said mixture of natural gas condensate and elemental sulfur over a cobalt/molybdenum catalyst in a reactor at a pressure of about 2–20 atmospheres and a temperature of about 75° C.–300° C., and simultaneously passing hydrogen gas over said catalyst.

13. A process according to claim 12 wherein said catalyst is presulfided by passing hydrogen sulfide over said catalyst prior to passing said mixture and said hydrogen gas over said catalyst.

14. A process according to claim 12 wherein said reactor vessel is maintained at a pressure between about 10–15 atmospheres.

15. A process according to claim 12 wherein said reactor vessel is maintained at a temperature between about 120° C.–250° C.

16. A process according to claim 12 wherein the volume of said condensate passing over said catalyst every hour divided by the volume of said catalyst is below about 20.

17. A process according to claim 12 wherein said mixture comprises between about 0.002–2% elemental sulfur.

18. A process according to claim 12 wherein said mixture comprises about 0.05% elemental sulfur.

* * * * *